US006328225B1

(12) United States Patent
Crampton

(10) Patent No.: US 6,328,225 B1
(45) Date of Patent: Dec. 11, 2001

(54) ROTARY FOAM NOZZLE

(75) Inventor: George Crampton, Carp (CA)

(73) Assignee: National Research Council of Canada, Ottawa (CA)

( * ) Notice: Subject to any disclaimer, the term of this patent is extended or adjusted under 35 U.S.C. 154(b) by 0 days.

(21) Appl. No.: 09/515,091

(22) Filed: Feb. 29, 2000

(51) Int. Cl.[7] ..... B05B 3/06
(52) U.S. Cl. ..... 239/246; 239/251
(58) Field of Search ..... 239/251, 246

(56) References Cited

U.S. PATENT DOCUMENTS

| | | |
|---|---|---|
| 4,463,583 | 8/1984 | Kruger et al. . |
| 4,981,178 | 1/1991 | Bundy . |
| 5,113,945 | 5/1992 | Cable . |
| 5,255,747 | 10/1993 | Teske et al. . |
| 5,291,951 | 3/1994 | Morand . |
| 5,411,100 | 5/1995 | Laskaris et al. . |
| 5,441,113 | 8/1995 | Pierce . |
| 5,582,776 | 12/1996 | Crawley . |
| 5,779,158 | 7/1998 | Baker . |
| 5,820,027 | 10/1998 | Szczurek . |

FOREIGN PATENT DOCUMENTS

| | | |
|---|---|---|
| 2131109 | 3/1996 | (CA) . |

OTHER PUBLICATIONS

Brackin et al., "The Pros and Cons of Class A Foam", *Fire Engineering*, Jul. 1992, pp. 59–66.

Colletti, D.J., "Class A Foam: an emerging technology; compressed–air foam mechanics", *Fire Engineering*, Mar. 1994 p. 61.

Colletti, D.J., "Quantifying the Effects of Class A Foam in Structure Firefighting: the Salem Tests", *Fire Engineering*, Feb. 1993, pp. 41–43.

Colletti, D.J., "Using Class A Foam for Structure Firefighting", *Firehouse*, Jul. 1998, p. 52–55,66–70,122–125.

Cowan, G., ". . . Is Class 'A' Foam", *Fire Fighting in Canada*, Mar. 1995, p. 8.

Crampton et al., "A New fire suppression technology", *NFPA Journal*, Jul./Aug. 1999, pp. 47–51.

Jones, K., "Put the White Stuff on the Red Stuff", *Fire Chief*, Mar. 1995, pp. 52–54.

Kim, A.K., "An Effective Compressed–Air–Foam Fire–Suppression System", *Canadian Consulting Engineer*, Mar. 1997, pp. 33–34.

Kim, A.K., "An Effective Compressed Air Foam Fire Suppression System", *Progress in Safety Science and Technology*, p.657–667.

Kim, A.K. et al., "A New Compressed–Air–Foam Technology", *Halon Options Technical Working Conference*, May 2–4, 2000, pp. 343–348.

Kim, A.K. et al., "Multipurpose Overhead Compressed–Air –Foam System and its Fire Suppression Performance", *Journal of Fire Protection Engineering*, 8(3) 1997, pp. 133–150.

Kim, A.K. et al., "Performance of Class A Compressed–Air –Foam From a Fixed System", *International Wildland Fire Foam Symposium*, 1996, pp. 26–30.

Liebson, J., "Safety, the Firefighter and Class A Foam", *Health and Safety for Fire and Emergency Service Personnel*, Jul. 1994.

Rochna, R., "Compressed Air Foam: What it is!", *American Fire Journal*, Aug. 1991, p. 28.

Wieder, M., "Foam: The Fire Service's Voodoo Science", *Firehouse*, Apr. 1997, p. 120.

*Primary Examiner*—Lesley D. Morris
(74) *Attorney, Agent, or Firm*—Freedman & Associates

(57) ABSTRACT

A rotary nozzle for compressed air foam (CAF) has a barrel mounted for rotation about an axis perpendicular to its longitudinal axis. The barrel is mounted to a CAF supply conduit and has a cross-sectional area substantially larger than the cross-sectional area of the conduit. Two non-equal orifices in the barrel, located on the opposite sides of the axis of rotation, distribute CAF such that it covers an almost complete, typically a circular area on the ground.

14 Claims, 2 Drawing Sheets

ROTARY FOAM NOZZLE

This invention relates to nozzles, and more particularly to a rotary nozzle suitable for distributing a stream of fire-extinguishing compressed-air foam, sufficient to extinguish or control a fire in the path of the foam stream.

In the art of fire-fighting, it is known to use foam produced from a solution of a foam concentrate in water. The volume of the solution is expanded by the addition of air and mechanical energy to form a bubble structure resembling shaving cream. The bubble suffocates and cools the fire and protects adjacent structures from exposure to radiant heat.

Foam can be generated using an air aspirating nozzle which entrains air into the solution and agitates the mixture producing bubbles of non-uniform size. With an aspirating system, the foam is formed at the nozzle using the energy of the solution stream.

Foam can also be generated by injecting air under pressure into the solution stream. The solution and air mixture is scrubbed by the hose (or pipe) to form foam of uniform bubble size. The energy used in this system comes from the solution stream and the air injection stream. This system produces a so-called "compressed-air foam" (CAF) which is capable of delivering the foam with a greater force than a comparable aspirated system described above.

When delivered from a hose, CAF is ejected as a "rope" of foam with a high forward momentum through a smooth bore nozzle. An attempt to widen the delivery angle using a conventional nozzle (such as e.g. a water sprinkler) results in collapsing the bubble structure of the foam and degenerating the foam back into a solution and air.

A published Canadian patent application No. 2,131,109 describes a foam nozzle having a stationary barrel and a rotary distributor with three tubular angled outlets. The design of the nozzle is such that the combined cross-sectional areas of the outlets are not less than the cross-sectional area of the barrel and not larger than twice the cross-sectional area of the barrel.

While the nozzle of the above application is useful, there is still need for a nozzle affording higher efficiency, lower profile, larger ground coverage and a more reliable rotational arrangement or bearing.

SUMMARY OF THE INVENTION

According to the invention, there is provided a nozzle for distributing an expanding stream of compressed-gas foam, the nozzle comprising:

- a supply conduit for supplying a foam-making solution, said conduit having a cross-sectional area,
- a rotary chamber in fluid communication with said supply conduit and defining an axis of rotation, said chamber having a cross-sectional area in a plane perpendicular to the axis of rotation, substantially larger than the cross-sectional area of the conduit, and
- at least two orifices in said rotary chamber, said orifices disposed on the opposite sides of the axis or rotation in a manner effective, upon a forced flow of fluid therethrough, to distribute each a stream of foam in a direction at an angle and tangentially to the axis of rotation such as to cause a rotational movement of the rotary chamber (in a direction counter to the direction of the streams of foam).

Preferably, the cross-sectional area of the chamber is between 150% and 300% of the cross-sectional area of the conduit.

DETAILED DESCRIPTION OF THE INVENTION

Figure 1:
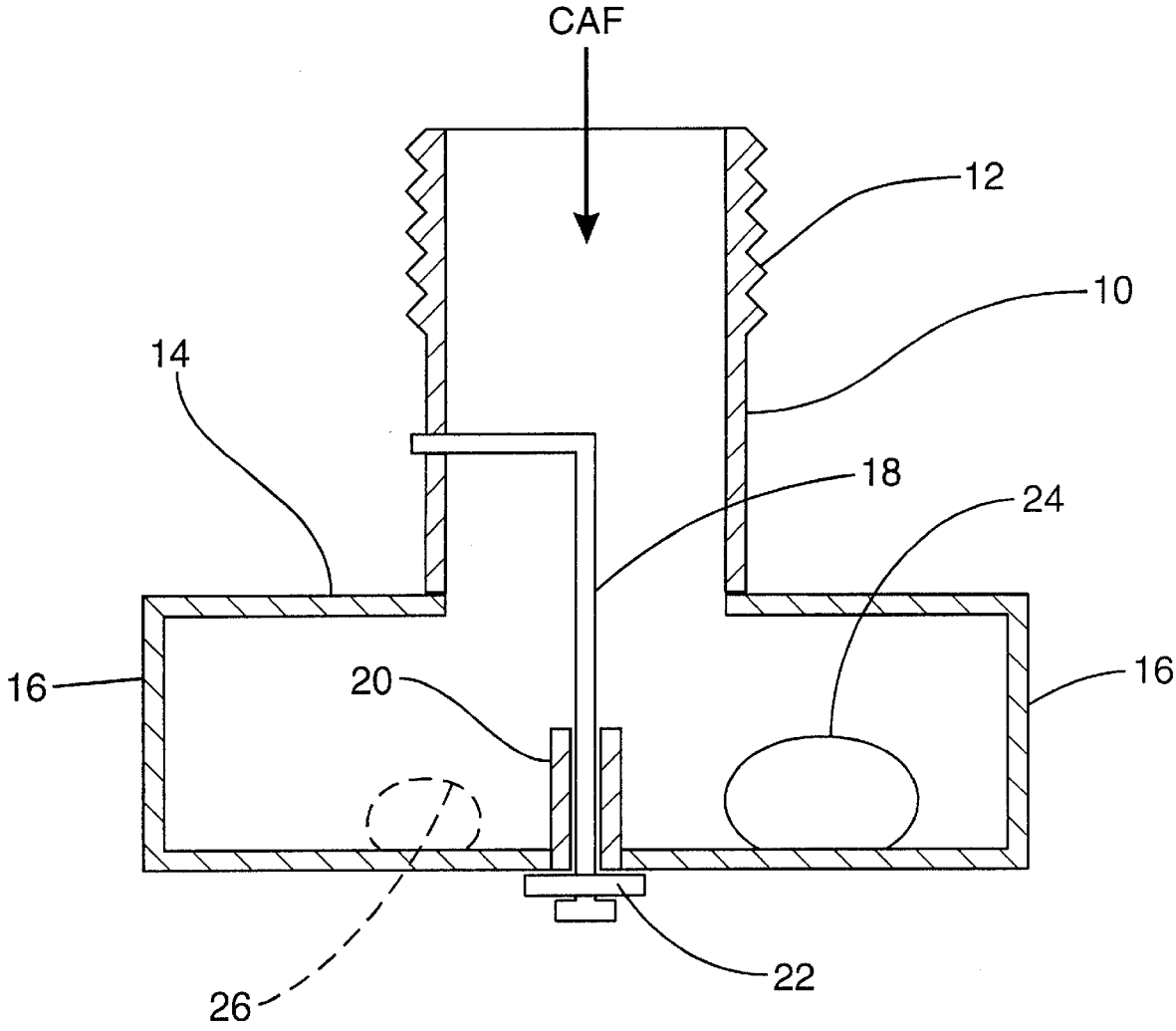
FIG. 1 is a schematic cross-sectional view of an embodiment of the nozzle of the invention, with the orifices directed downwards.

FIG. 1 shows a typical compressed-air foam nozzle of the invention. The nozzle has a stationary tubing 10 which has a thread 12 for connecting the nozzle to a foam solution supply system, not shown. A tubular barrel 14 with sealed ends 16 is mounted rotatably to the tubing 10 by means of a spindle 18 which is welded to the tubing 10. The vertical section of the spindle 18 as illustrated defines the axis of rotation. A loose-fit bearing sleeve 20 or an equivalent bearing is provided on the spindle 18 to facilitate the rotation. A washer 22 is mounted at the passage of the spindle 18 through the sleeve 20 to reduce leaks and provide a thrust bearing surface.

The total maximum dimension of the nozzle in the embodiment illustrated herein is about 5 cm (2 in.)

In the embodiment illustrated, the barrel is disposed for rotation around a vertical axis, but can of course be installed such that the axis of rotation is at an angle to vertical.

Preferably, the cross-sectional area of the barrel 14 is between 150% and 300% of the cross-sectional area of the tubing 10. The relatively larger size of the barrel is intended to provide some manifold pressure to balance the delivery of foam from each side of the vertical axis of rotation. The size of the barrel is limited by its mass (too heavy a barrel would not function properly), therefore it is advantageous to design the barrel from a relatively light material e.g. an aluminum alloy. Also, the quality of the bearing plays an important role.

Two orifices 24, 26 are provided in the lower part of the barrel. The orifice 24 as illustrated is positioned in front of the barrel while the smaller orifice 26, represented in phantom lines, is disposed in the rear of the barrel. The orifices are positioned off-center (i.e. off the vertical plane of symmetry of the barrel). The orifices are also disposed on the opposite side of the vertical symmetry plane of the barrel. This arrangement results, when a stream of fluid is delivered in operation to the barrel through the tubing 10, in jets of the fluid being ejected downwards, tangentially to the axis of rotation of the barrel thus causing a rotation of the barrel about the axis.

In the embodiment illustrated, the orifices are of non-equal size and are spaced non-symmetrically relative to the axis of rotation. This is dictated by the need to balance the forces acting on the barrel due to the flow of the fluid through the barrel and its orifices.

Figure 2:
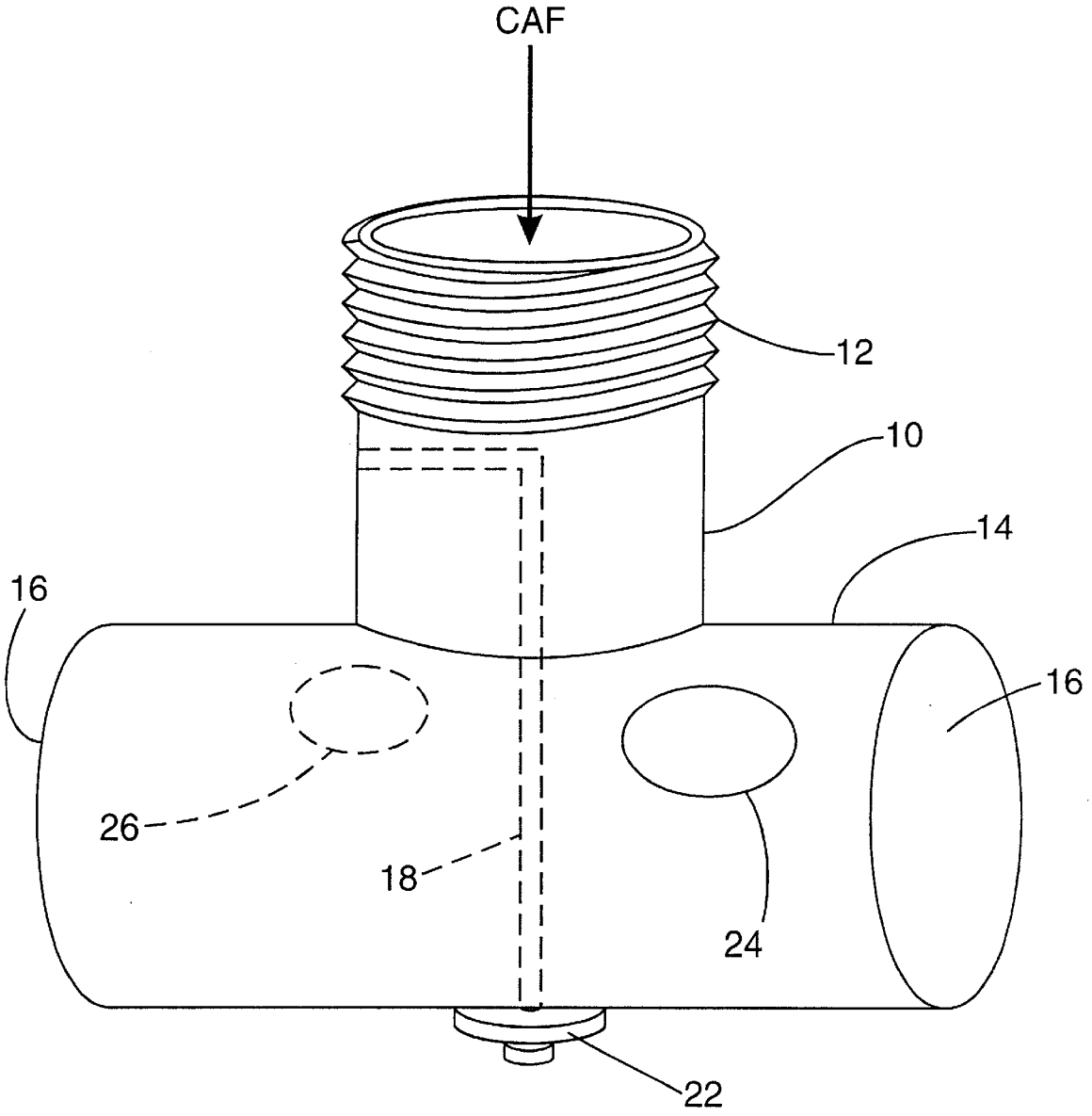
FIG. 2 is a side view of another embodiment of the invention, with the orifices pointing upwards.

Alternatively, as shown in FIG. 2, the orifices can also be located in an upper region of the barrel, above its mid-line. Again, the smaller orifice 26 is disposed in the back of the barrel while the orifice 24 is disposed in the front of the barrel as illustrated. Such arrangement would result in the CAF being distributed e.g. toward the ceiling above the nozzle level.

The number of orifices can be quite significant, but it has been found that two orifices provide optimum balance and delivery momentum. The orifices can be of various shapes—round, oval, triangular, provided that the combined cross-sectional area is not less than ½ or greater than twice the cross sectional area of the supply conduit.

In operation, a compressed air foam, known in the art, is passed to the barrel through the tubing 10. The foam fills the barrel and is ejected by the orifices in two separate streams without being substantially degenerated into a foam solution and air. The tangential flow of the foam causes the barrel to rotate. One of the streams forms an annular pattern at the target below the nozzle (in the embodiment of FIG. 1) or above the nozzle (as per FIG. 2), and the other stream forms a second annular or circular pattern. The size and position of the orifices can be selected such as to fill a desired target area with the foam.

What is claimed is:

1. A nozzle for delivering an expanding stream of a compressed-gas foam to a predetermined target area, the nozzle comprising:

a supply conduit for supplying the compressed-gas foam, said conduit having a cross-sectional area;

a rotary chamber in fluid communication with said supply conduit and defining an axis of rotation, said chamber having a cross-sectional area in a plane perpendicular to the axis of rotation substantially larger than the cross-sectional area of the conduit; and, two orifices in said rotary chamber, at least one of the two orifices having a cross-sectional area larger than approximately one-half the cross-sectional area of the conduit, said orifices disposed on opposite sides of the axis of rotation in a manner effective, upon a forced flow of the compressed-gas foam therethrough, to distribute each a stream of the compressed-gas foam directed substantially at the predetermined target area, wherein each stream of the compressed-gas foam is launched along a trajectory having a component that is tangential to a circular path coaxial with the axis of rotation such as to cause a rotational movement of the rotary chamber.

2. The nozzle according to claim 1 wherein said chamber is barrel-shaped.

3. The nozzle according to claim 1 wherein said chamber has a shape of a tube with closed ends.

4. The nozzle according to claim 3 wherein said orifices are disposed in portions of said tube that are inclined to the horizontal.

5. The nozzle according to claim 1 wherein said orifices have non-equal sizes and are spaced at a non-equal distance from the axis of rotation.

6. The nozzle according to claim 1 wherein said orifices are disposed on the underside of said chamber.

7. The nozzle according to claim 1 wherein said orifices are disposed on the upper side of said chamber to distribute said foam above the level of said nozzle.

8. The nozzle according to claim 1 wherein said cross-sectional area of said chamber is between 150% and 300% of the cross-sectional area of said conduit.

9. The nozzle according to claim 1 wherein the combined cross-sectional area of said orifices is not less than half and not greater than twice the cross-sectional area of the supply conduit.

10. A nozzle for delivering an expanding stream of a compressed-gas foam to a predetermined target area, the nozzle comprising:

a supply conduit for supplying the compressed-gas foam, said supply conduit having a cross-sectional area;

a central bearing including a thin-shaft spindle having a first portion coaxial with the supply conduit and defining an axis of rotation and a second portion for engaging the supply conduit at an inner surface thereof;

a chamber in fluid communication with said supply conduit, said chamber mounted rotatably to the supply conduit by the central bearing; and, at least two orifices in said chamber, said orifices disposed on opposite sides of the axis of rotation in a manner effective, upon forced flow of the compressed-gas foam therethrough, to distribute each a stream of the compressed-gas foam directed substantially at the predetermined target area, wherein each stream of the compressed-gas foam is launched along a trajectory having a component that is tangential to a circular path coaxial with the axis of rotation such as to cause a rotational movement of the chamber.

11. A nozzle for delivering an expanding stream of a compressed-gas foam to a predetermined target area as defined in claim 10 wherein the central bearing consists of a single bent thin-shaff spindle with the second portion extending from the inner surface of the conduit and the first portion coaxial with the supply conduit and defining the axis of rotation.

12. A nozzle for delivering an expanding stream of a compressed-gas foam to a predetermined target area as defined in claim 10 wherein the chamber in fluid communication with said supply conduit is an elongate chamber extending beyond the inner surface of the supply conduit on two opposing sides thereof and wherein the two orifices are disposed one for distributing compressed-gas foam to a central portion of the target area and the other for distributing compressed-gas foam to a peripheral portion of the target area.

13. A nozzle for delivering an expanding stream of a compressed-gas foam to a predetermined target area as defined in claim 10 wherein the two orifices are of sufficient size that foam delivered therefrom for covering the target area is substantially similar to the foam within the supply conduit.

14. A nozzle for delivering a stream of a compressed-gas foam to a predetermined target area of at least 100 sq feet, the nozzle comprising:

a supply conduit for supplying the compressed-gas foam, said supply conduit having a cross-sectional area;

a rotatable nozzle having an orifice for delivering the compressed-gas foam to the predetermined target area of at least 100 sq feet, rotation of the nozzle effected by a pressure of the compressed-gas foam, wherein the pressure of the compressed gas foam and the size and shape of the at least an orifice is for effecting rotation of the nozzle to support approximately even coverage of the target area and to provide foam of approximately a same composition and air content as that in the supply conduit.

* * * * *